US006296560B1

(12) United States Patent
Quick

(10) Patent No.: US 6,296,560 B1
(45) Date of Patent: Oct. 2, 2001

(54) CHIMNEY CAP ASSEMBLY

(76) Inventor: William J. Quick, 14 Floral Rd., Flemington, NJ (US) 08822

( * ) Notice: Subject to any disclaimer, the term of this patent is extended or adjusted under 35 U.S.C. 154(b) by 0 days.

(21) Appl. No.: 09/536,407

(22) Filed: Mar. 28, 2000

(51) Int. Cl.[7] ..... F23J 13/08
(52) U.S. Cl. ..... 454/44; 285/42
(58) Field of Search ..... 454/3, 4, 35, 37, 454/44, 47; 285/42

(56) References Cited

U.S. PATENT DOCUMENTS

| | | | | |
|---|---|---|---|---|
| 197,033 | * | 11/1877 | Hull | 454/354 |
| 509,947 | * | 12/1893 | Reynolds | 454/4 |
| 760,092 | * | 5/1904 | Warlick | 454/4 |
| 937,254 | * | 10/1909 | Maier | 454/4 |
| 1,103,666 | * | 7/1914 | Fife | 454/12 |
| 5,009,220 | * | 4/1991 | Cornelison | 126/523 |
| 5,025,712 | * | 6/1991 | Perry | 454/354 |
| 5,536,048 | * | 7/1996 | Orr | 285/42 |
| 5,842,918 | * | 12/1998 | Cowen | 454/12 |

* cited by examiner

*Primary Examiner*—Narold Joyce
*Assistant Examiner*—Derek S. Boles
(74) *Attorney, Agent, or Firm*—Welsh & Flaxman LLC

(57) ABSTRACT

A chimney cap assembly for use in the installation of non-masonry chimneys including a chimney chase and a centrally extending chimney pipe. The chimney cap assembly includes a one-piece chimney cap for positioning upon the chimney chase. The chimney cap includes a central opening shaped and dimensioned for positioning about the chimney pipe, wherein the central opening includes an upwardly extending flange. The chimney cap assembly further includes a collar member having an inner edge positioned at the top of the collar member and an outer edge positioned at the bottom of the collar member. The collar member is positioned above the chimney cap such that the bottom of the collar member substantially overlaps the upwardly extending flange along a longitudinal axis extending along the chimney pipe. In addition, the inner edge of the collar member is secured to the chimney pipe creating a seal therebetween. The overlap between the upwardly extending flange and the collar member substantially prevents the passage of undesirable objects between the chimney chase and the chimney pipe without necessitating the formation of a seal between the collar and the chimney cap.

19 Claims, 4 Drawing Sheets

CHIMNEY CAP ASSEMBLY

BACKGROUND OF THE INVENTION

1. Field of the Invention

The invention relates to a chimney cap assembly. More particularly, the invention relates to a chimney cap assembly employing a one-piece chimney cap and a collar member to prevent the passage of undesirable objects between the chimney chase and the chimney pipe.

2. Description of the Prior Art

With the recent proliferation of houses, townhouses and condominiums including non-masonry chimneys the shortcomings of prior chimney cap assemblies have become highly apparent. Specifically, and with reference to FIG. 1, non-masonry chimneys 1 are currently assembled with a chimney pipe 2 extending within a chimney chase 3. The gap 4 formed between the chimney pipe 2 and the chimney chase 3 must be covered to prevent the passage of undesirable objects between the chimney pipe 2 and the chimney chase 3.

This gap 4 is commonly covered by the application of a collar 5 to the outer wall 6 of the chimney pipe 2. The collar 5 also sits over a multiple piece chimney cap 7. The edge 8 of the collar 5 is securely sealed to the chimney pipe 2 through the application of caulk 9 at the joint where the collar 5 meets the chimney pipe 2. The multiple piece chimney cap 7 is generally formed with a flat plate 7*a* having an upwardly extending flange 7*b* secured thereto through the use of caulk 9*a*.

Over time, however, the caulk 9*a* bonding the upwardly extending flange 7*b* to the flat plate 7*a* is subjected to sitting water and other corrosive agents which cause the caulk joint therebetween to rot and require maintenance. This is highly undesirable for homeowners and may result in substantial damage where the seal is not properly and timely repaired. When the caulk rots in this manner, moisture, animals and other debris may enter the space between the chimney pipe and the chimney chase, causing substantial damage to the structure of the building. In addition, the chimney cap 7 is commonly made from unpainted galvanized steel, which is highly susceptible to rusting and corrosion.

As such, a need exists for an improved chimney cap assembly. The present invention provides such a chimney cap assembly.

SUMMARY OF THE INVENTION

It is, therefore, an object of the present invention to provide a chimney cap assembly for use in the installation of non-masonry chimneys including a chimney chase and a centrally extending chimney pipe. The chimney cap assembly includes a chimney cap for positioning upon the chimney chase. The chimney cap includes a central opening shaped and dimensioned for positioning about the chimney pipe, wherein the central opening includes an upwardly extending flange. The chimney cap assembly further includes a collar member having an inner edge positioned at the top of the collar member and an outer edge positioned at the bottom of the collar member. The collar member is positioned above the chimney cap such that the bottom of the collar member substantially overlaps the upwardly extending flange along a longitudinal axis extending along the chimney pipe. In addition, the inner edge of the collar member is secured to the chimney pipe creating a seal therebetween. The overlap between the upwardly extending flange and the collar member substantially prevents the passage of undesirable objects between the chimney chase and the chimney pipe without necessitating the formation of a seal between the collar and the chimney cap.

It is also an object of the present invention to provide a chimney cap assembly wherein the chimney cap is formed from aluminum.

It is another object of the present invention to provide a chimney cap assembly wherein the collar member is formed from galvanized steel.

It is a further object of the present invention to provide a chimney cap assembly wherein the upwardly extending flange is formed with a radiused curve.

It is also another object of the present invention to provide a chimney cap assembly wherein the central opening has a diameter approximately 0.25 inches larger than that of the chimney pipe.

It is yet another object of the present invention to provide a chimney cap assembly wherein caulk secures the collar member to the chimney pipe.

It is still a further object of the present invention to provide a chimney cap assembly wherein the chimney cap includes a downwardly extending edge detail shaped and dimensioned to fit about an edge of the chimney chase.

It is also an object of the present invention to provide a chimney cap assembly including a spark arrester positioned above an open end of the chimney pipe.

It is another object of the present invention to provide a chimney cap assembly including a one-piece chimney cap for positioning upon the chimney chase. The chimney cap includes a central opening shaped and dimensioned for positioning about the chimney pipe, wherein the central opening includes an upwardly extending flange. The chimney cap assembly further includes a pipe cover shaped and dimensioned for covering an open end of the chimney pipe. The pipe cover includes a collar member having an inner edge positioned at the top of the collar member and an outer edge positioned at the bottom of the collar member. The collar member is positioned above the chimney cap such that the bottom of the collar member substantially overlaps the upwardly extending flange along a longitudinal axis extending along the chimney pipe. The overlap between the upwardly extending flange and the collar member substantially prevents the passage of undesirable objects between the chimney chase and the chimney pipe without necessitating the formation of a seal between the collar and the chimney cap.

Other objects and advantages of the present invention will become apparent from the following detailed description when viewed in conjunction with the accompanying drawings, which set forth certain embodiments of the invention.

DESCRIPTION OF THE PREFERRED EMBODIMENTS

The detailed embodiments of the present invention are disclosed herein. It should be understood, however, that the disclosed embodiments are merely exemplary of the invention, which may be embodied in various forms. Therefore, the details disclosed herein are not to be interpreted as limited, but merely as the basis for the claims and as a basis for teaching one skilled in the art how to make and/or use the invention.

Figure 1:
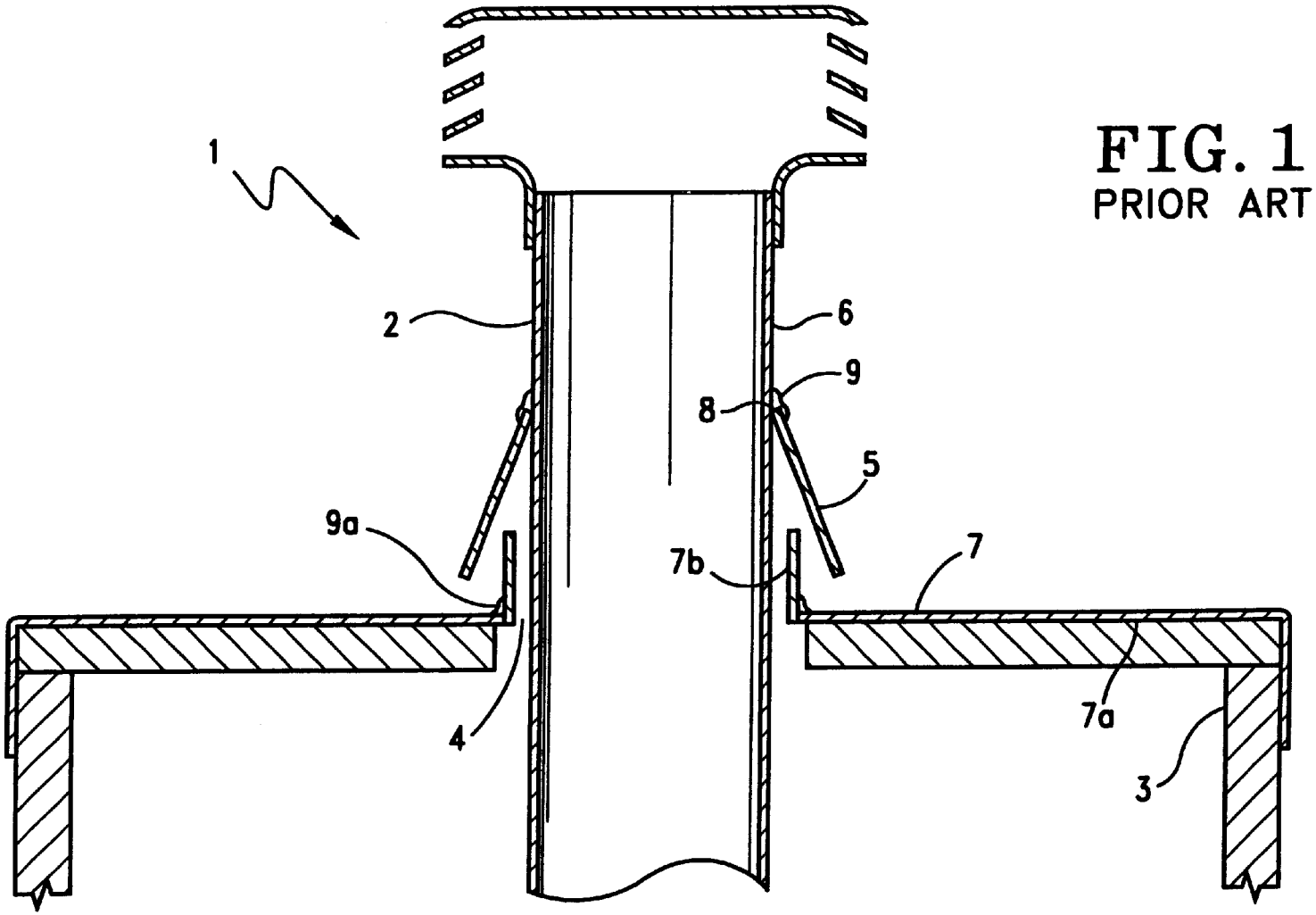
FIG. 1 PRIOR ART
FIG. 1 is a cross sectional view of a prior art chimney cap assembly.
Figure 2:
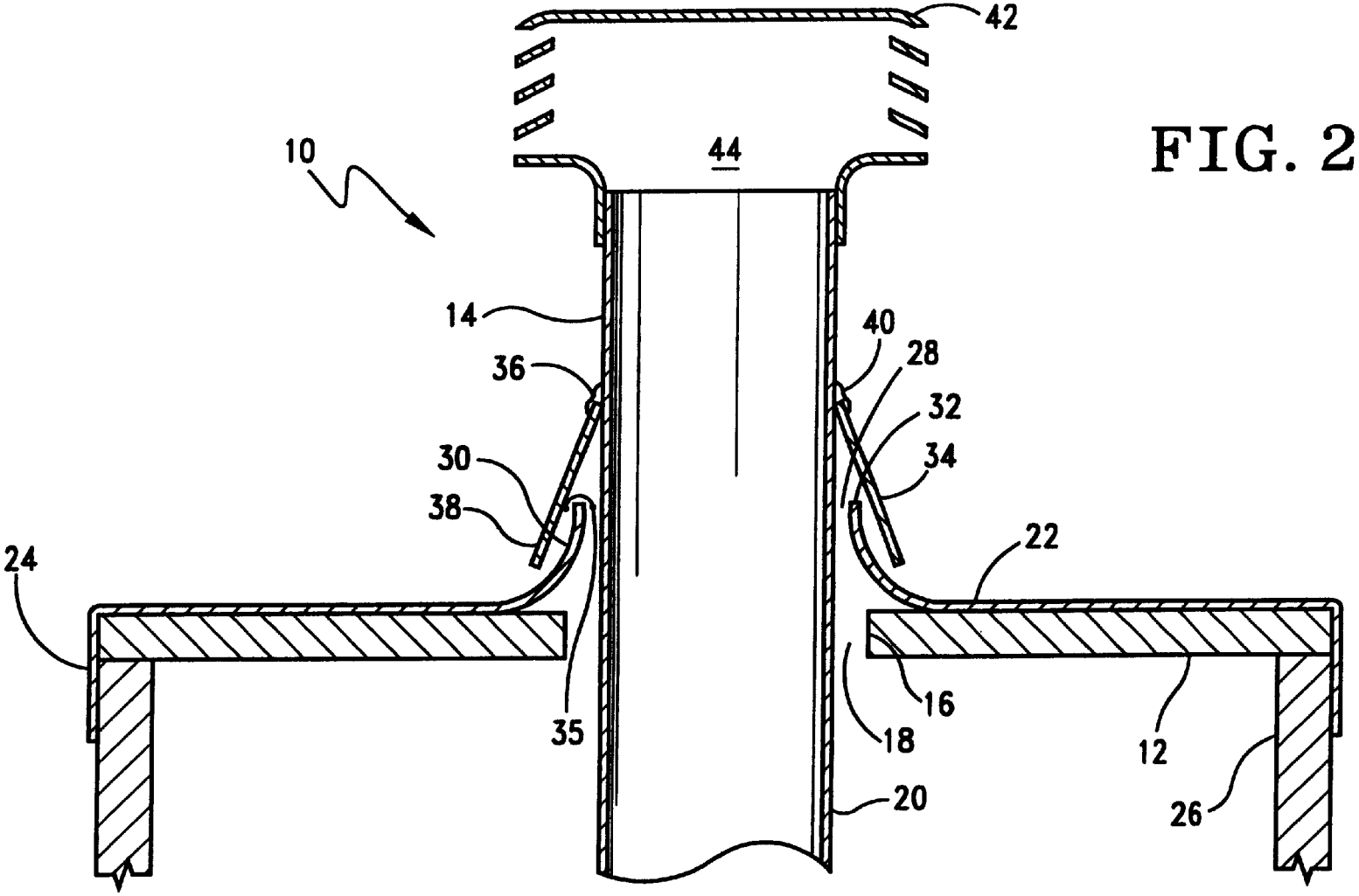
FIG. 2 is a cross sectional view of a chimney cap assembly in accordance with the present invention.

With reference to FIG. 2, a chimney cap assembly 10 is disclosed. The chimney cap assembly 10 is specifically designed for use in the installation of non-masonry chimneys including a chimney chase 12 and a centrally extending chimney pipe 14. However, those skilled in the art will readily appreciate a variety of other applications within the spirit of the present invention.

As discussed above with regard to the "Background of the Invention", non-masonry chimneys are generally constructed with a chimney chase 12, or chimney sheathing/framing, in which the chimney pipe 14 is positioned. While the term chimney pipe is used in describing the present invention, those skilled in the art will appreciate the variety of terms which may be used, including, but not limited to, vent or plumbing pipe. At the point at which the chimney pipe 14 exits the chimney chase 12 a small opening 16 is created in the chimney chase 12 sufficient to permit the passage of the chimney pipe 14 therethrough.

The present chimney cap assembly 10 closes the gap 18 existing between the opening 16 and the outer wall 20 of the chimney pipe 14. With this in mind, the present chimney cap assembly 10 includes a one-piece chimney cap 22 for positioning upon the top of the chimney chase 12. The chimney cap 22 is preferably formed from a single sheet of aluminum, although the chimney cap 22 may be constructed from a variety of corrosive resistant materials without departing from the spirit of the present invention. In accordance with a preferred embodiment of the present invention, the chimney cap 22 is shaped and dimensioned to fit over the top portion of the chimney chase 12 to protect the chimney chase 12 from the environment.

The chimney cap 22 disclosed herein is, therefore, provided with a downwardly extending edge detail 24 designed to encompass the outer edge 26 of the chimney chase 12. This edge detail provides for a secure attachment between the chimney cap 22 and the chimney chase 12 upon which it is positioned. While a specific edge detail is disclosed in accordance with a preferred embodiment of the present invention, the general shape of the chimney cap may be varied to suit specific applications associated with various chimney chases without departing from the spirit of the present invention.

The chimney cap 22 includes a central opening 28 shaped and dimensioned for positioning about the chimney pipe 14. In accordance with a preferred embodiment of the present invention, the chimney cap is formed from a single sheet of aluminum with the central opening 28 cut therein. The central opening 28 includes an upwardly extending flange 30 which extends substantially along the longitudinal axis of the chimney pipe 14. The upwardly extending flange 30 is preferably formed by pressing the sheet outwardly along the central opening 28 under the control of a pressing apparatus and is, therefore, formed as a single piece with the chimney cap 22 to thereby prevent the corrosive effects commonly associated with prior art assemblies. However, those skilled in the art will appreciate a variety of methods for forming the flange 30 within the spirit of the present invention. The upwardly extending flange 30 disclosed herein is a radiused flange. However, those skilled in the art will appreciate the many shapes which the upwardly extending flange may take without departing from the spirit of the present invention. In addition, although the present invention is disclosed herein with a single central opening for the passage of the chimney pipe therethrough, the chimney cap may be formed with multiple openings where multiple chimney pipes are stored within a single chimney chase.

The central opening 28 is defined by an inner edge 32 which encircles the chimney pipe 14. With this in mind, the central opening 28 is shaped to be slightly larger than the outer diameter of the chimney pipe 14. In fact, it is contemplated that the central opening 28 should be sized such that the inner edge 32 thereof is positioned approximately 0.25 inches from the outer wall 20 of the chimney pipe 14. This air gap 35 allows for expansion and contraction of the various components making up the present chimney cap assembly 10.

The chimney cap assembly 10 further includes a collar member 34. As with the chimney cap 22, the collar member 34 is preferably formed from galvanized steel although the collar member may be constructed from a variety of materials without departing from the spirit of the present invention. The collar member 34 includes an inner edge 36 positioned at the top of the collar member 34 and outer edge 38 positioned at the bottom of the collar member 34; that is, when the collar member 34 is properly positioned on the chimney pipe 14, it extends downward and outwardly, and is oriented to substantially resemble an upside down funnel.

With this in mind, the inner edge 36 of the collar member 34 is secured to the outer wall 20 of the chimney pipe 14 with caulk 40, or some other sealing member. The collar member 34 extends outwardly and downwardly from its connection with the chimney pipe 14. The collar member 34 extends downwardly and is positioned above the chimney cap 22 such that the bottom of the collar member 34 substantially overlaps the upwardly extending flange 30 along a longitudinal axis extending along the chimney pipe 14.

The orientation of the bottom of the collar member 34 overlapping the upwardly extending flange 30 of the chimney cap 22 substantially prevents the passage of undesirable objects between the chimney chase 12 and the chimney pipe 14 without requiring the formation of a seal between the collar member 14 and the chimney cap 12. For example, the orientation of the upwardly extending flange 30 relative to the collar member 34 substantially prevents the passage of rain, leaves, debris, animals and other objects past the collar member 34, and between the chimney chase 12 and the chimney pipe 14. In addition to preventing the passage of undesirable objects, the present assembly 10 provides a unitary chimney cap 22 not effected by the corrosive action of standing water and other corrosive agents Further protection of the chimney pipe 14 is provided by the inclusion of a spark arrester 42, or similar pipe top, positioned over the open end 44 of the chimney pipe 14.

Figure 3:
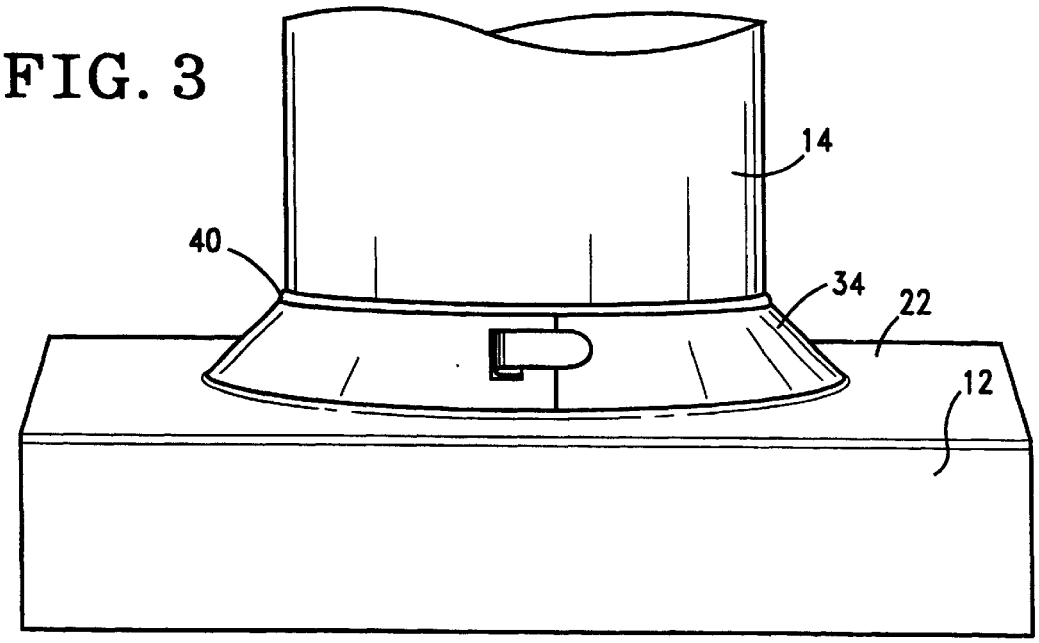
FIG. 3 is a side view of the chimney cap assembly shown in FIG. 2.
Figure 4:
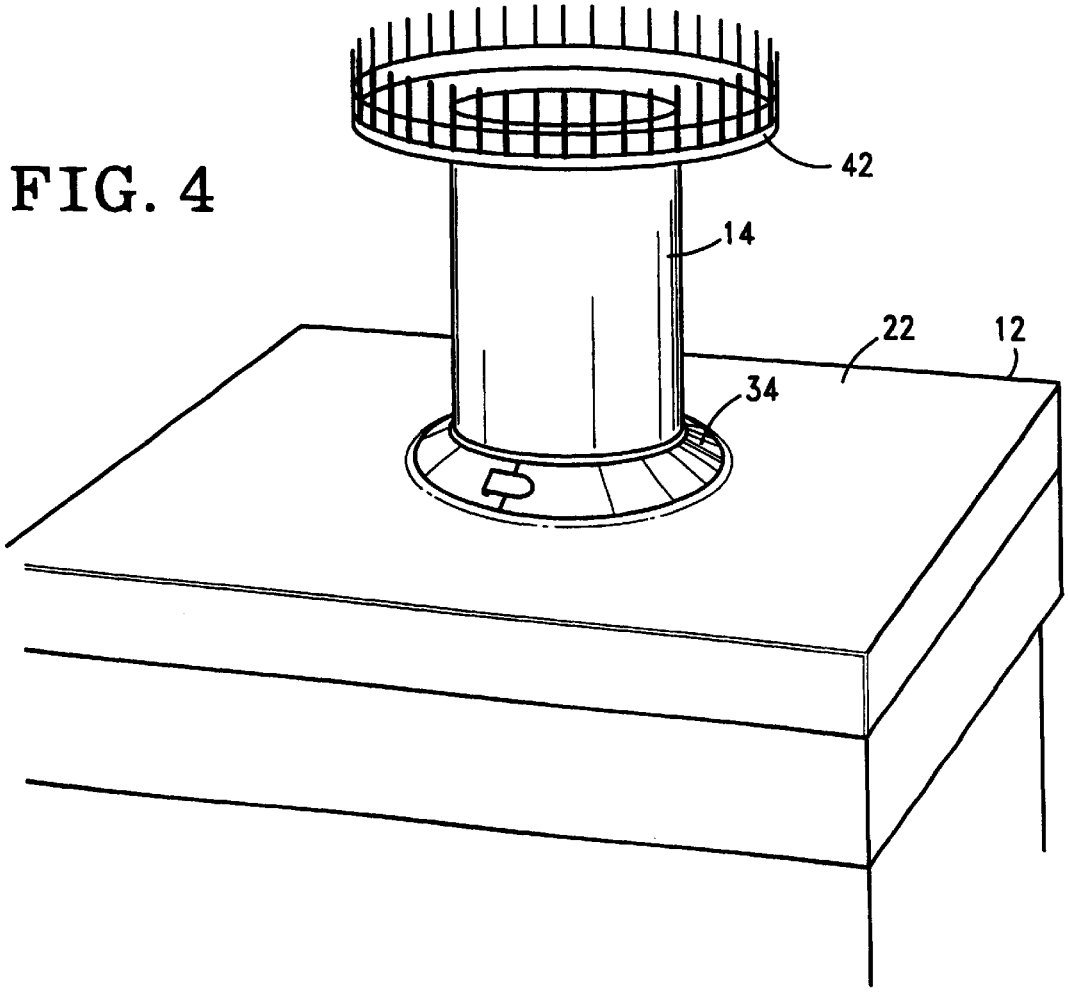
FIG. 4 is a perspective view of the chimney cap assembly shown in FIG. 2.
Figure 5:
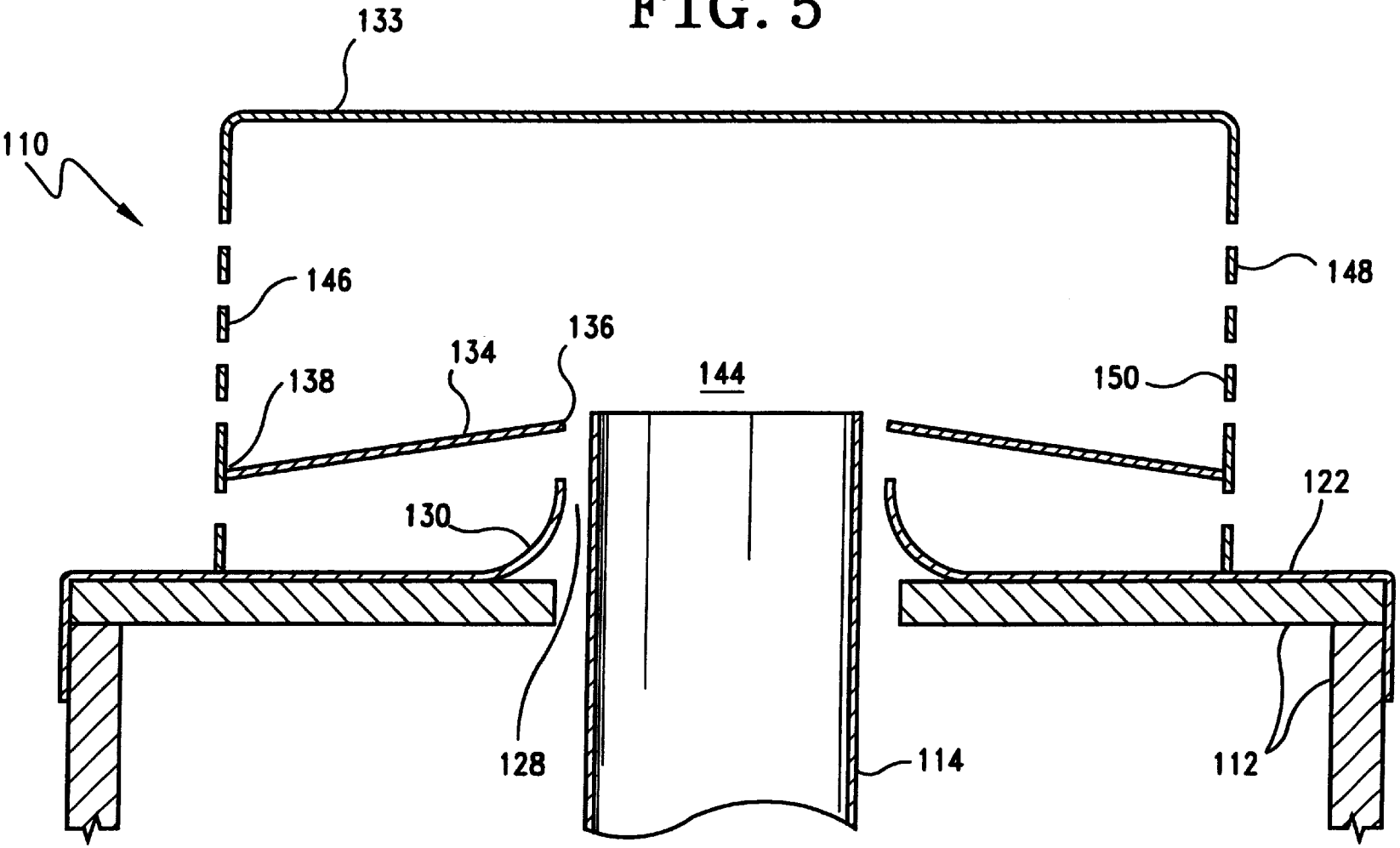
FIG. 5 is a cross sectional view of a second embodiment of a chimney cap assembly in accordance with the present invention.

An alternate embodiment of the present invention is disclosed in FIG. 5. As with the embodiment disclosed in FIGS. 2 to 4, the chimney cap assembly 110 disclosed in FIG. 5, is primarily designed for use in the installation of non-masonry chimneys including a chimney chase 112 and a centrally extending chimney pipe 114. However, the chimney cap assembly 110 may be used for various purposes without departing from the spirit of the present invention.

The chimney cap assembly 110 includes a one-piece chimney cap 122 for positioning upon the chimney chase 112. The chimney cap 122 includes a central opening 128 shaped and dimensioned for positioning about the chimney pipe 114, wherein the central opening 128 includes an upwardly extending flange 130.

The chimney cap assembly 110 further includes a pipe cover 133 shaped and dimensioned for covering the open end 144 of the chimney pipe 114. The pipe cover 133 is substantially dome-shaped with vents 146 formed along its lateral edges 148 to readily permit the passage of fumes therethrough. The lateral edges 148 of the pipe cover 133 sit upon the chimney cap 122 and are secured thereto. As those skilled in the art will readily appreciate, so long as the pipe cover 133 is shaped and dimensioned to cover the open end 144 of the chimney pipe 114 it may take a variety of forms without departing from the spirit of the present invention.

A collar member 134 is secured within the piper cover 133. Specifically, the collar member 134 includes an inner edge 136 positioned at the top of the collar member 134 and an outer edge 138 positioned at the bottom of the collar member 134 such that the collar member extends downwardly and outwardly. The outer edge is 138 attached directly to the inner wall 150 of the pipe cover 133 in a manner securely mounting the collar member 134 within the pipe cover 133. The collar member 134 is positioned within the pipe cover 133 such that it lies above the chimney cap 122 with the bottom of the collar member 134 substantially overlapping the upwardly extending flange 130 along a longitudinal axis extending along the chimney pipe 114. In this way, the overlap between the upwardly extending flange 130 and the collar member 134 substantially prevents the passage of undesirable objects between the chimney chase 112 and the chimney pipe 114 without necessitating the formation of a seal between the collar member 134 and the chimney cap 122.

While the preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A chimney cap assembly for use in the installation of non-masonry chimneys including a chimney chase and a centrally extending chimney pipe, comprising:

a one-piece chimney cap formed of a single sheet of material for positioning upon the chimney chase, the chimney cap including a central opening shaped and dimensioned for positioning about the chimney pipe, wherein the central opening includes an upwardly extending flange formed as a single piece with the chimney cap;

a collar member including an inner edge positioned at the top of the collar member and an outer edge positioned at the bottom of the collar member, the collar member is positioned above the chimney cap such that the bottom of the collar member substantially overlaps, and is spaced from, the upwardly extending flange along a longitudinal axis extending along the chimney pipe and the entire circumference of the bottom of the collar member is spaced from the chimney cap; and the inner edge of the collar member is secured to the chimney pipe with a seal therebetween; and wherein the overlap between the upwardly extending flange and the collar member substantially prevents the passage of undesirable objects between the chimney chase and the chimney pipe without necessitating the formation of a seal between the collar and the chimney cap.

2. The chimney cap assembly according to claim 1, wherein the chimney cap is formed from aluminum.

3. The chimney cap assembly according to claim 1, wherein the collar member is formed from galvanized steel.

4. The chimney cap assembly according to claim 1, wherein the upwardly extending flange is formed with a radiused curve.

5. The chimney cap assembly according to claim 1, wherein caulk secures the collar member to the chimney pipe.

6. The chimney cap assembly according to claim 1, wherein the chimney cap includes a downwardly extending edge detail shaped and dimensioned to fit about an edge of the chimney chase.

7. The chimney cap assembly according to claim 1, wherein the edge detail is integrally formed with the chimney cap.

8. The chimney cap assembly according to claim 1, wherein the central opening has a diameter approximately 0.25 inches larger than that of the chimney pipe.

9. A chimney cap assembly for use in the installation of non-masonry chimneys including a chimney chase and a centrally extending chimney pipe, comprising:

a one-piece chimney cap for positioning upon the chimney chase, the chimney cap including a central opening shaped and dimensioned for positioning about the chimney pipe, wherein the central opening includes an upwardly extending flange formed as a single piece with the chimney cap;

a pipe cover shaped and dimensioned for covering an open end of the chimney pipe, the pipe cover including a collar member having an inner edge positioned at the top of the collar member and an outer edge positioned at the bottom of the collar member, the collar member is positioned above the chimney cap such that the bottom of the collar member substantially overlaps the upwardly extending flange along a longitudinal axis extending along the chimney pipe; and wherein the overlap between the upwardly extending flange and the collar member substantially prevents the passage of undesirable objects between the chimney chase and the chimney pipe without necessitating the formation of a seal between the collar and the chimney cap.

10. The chimney cap assembly according to claim 9, wherein the chimney cap is formed from aluminum.

11. The chimney cap assembly according to claim 9, wherein the pipe cover is formed from galvanized steel.

12. The chimney cap assembly according to claim 9, wherein the upwardly extending flange is formed with a radiused curve.

13. The chimney cap assembly according to claim 9, wherein the collar member is attached to an inner wall of the pipe cover.

14. The chimney cap assembly according to claim 9, wherein the chimney cap includes a downwardly extending edge detail shaped and dimensioned to fit about an edge of the chimney chase.

15. The chimney cap assembly according to claim 12, wherein the edge detail is integrally formed with the chimney cap.

16. The chimney cap assembly according to claim 9, wherein the pipe cover includes vent holes.

17. The chimney cap assembly according to claim 9, wherein the central opening has a diameter approximately 0.25 inches larger than that of the chimney pipe.

18. The chimney cap assembly according to claim 9, wherein the pipe cover includes lateral edges which are secured to the chimney cap.

19. The chimney cap assembly according to claim 18, wherein the pipe cover includes vent holes formed within the lateral edges.

* * * * *